US008419610B2

(12) United States Patent
Matsubara et al.

(10) Patent No.: US 8,419,610 B2
(45) Date of Patent: Apr. 16, 2013

(54) INFANT CARE APPARATUS

(75) Inventors: Kazuo Matsubara, Tokyo (JP); Eiji Koike, Saitama (JP); Shinchi Kobayashi, Saitama (JP); Masato Honda, Saitama (JP); Hidetoshi Sato, Saitama (JP); Keisuke Wakabayashi, Saitama (JP)

(73) Assignee: Atom Medical Corporation, Tokyo (JP)

( * ) Notice: Subject to any disclaimer, the term of this patent is extended or adjusted under 35 U.S.C. 154(b) by 456 days.

(21) Appl. No.: 12/756,862

(22) Filed: Apr. 8, 2010

(65) Prior Publication Data

US 2010/0286471 A1 Nov. 11, 2010

(30) Foreign Application Priority Data

May 8, 2009 (JP) ..... 2009-113564

(51) Int. Cl.
*A61G 11/00* (2006.01)

(52) U.S. Cl.
USPC ..... 600/22; 236/2; 237/3

(58) Field of Classification Search ..... 600/21–22; 128/846; 237/3; 5/603; 340/573.1; 236/2
See application file for complete search history.

(56) References Cited

U.S. PATENT DOCUMENTS

| | | | | |
|---|---|---|---|---|
| 3,858,570 | A * | 1/1975 | Beld et al. | 600/22 |
| 6,022,310 | A * | 2/2000 | Goldberg et al. | 600/22 |
| 6,669,625 | B2 * | 12/2003 | Costanzo et al. | 600/22 |
| 6,893,390 | B1 * | 5/2005 | Mackin | 600/22 |
| 7,482,558 | B2 * | 1/2009 | Koch | 219/543 |
| 2005/0070756 | A1 | 3/2005 | Falk et al. | |

* cited by examiner

*Primary Examiner* — Charles A Marmor, II
*Assistant Examiner* — Laura Fajardo
(74) *Attorney, Agent, or Firm* — Hunton & Williams LLP

(57) ABSTRACT

In an infant care apparatus according to this invention, heat rays are radiated from a heat radiation opening of a heater to a bed. The direction of the heat radiation opening can be changed from the first state in which the heat radiation opening substantially faces the bed to the second state in which the heat radiation opening does not substantially face the bed. According to the infant care apparatus of this invention, when the heater is not used, there is no possibility that the remaining heat of the heater is transferred to the infant laying on the bed. There is therefore no possibility that the infant will be unnecessarily overheated. There is no need to operate the heater and the like of the infant care apparatus in such a manner that the infant lying on the bed and surrounding people have feelings that rough operation is performed. This will keep the infant and the surrounding people free from adverse effects in terms of mental health.

15 Claims, 13 Drawing Sheets

INFANT CARE APPARATUS

TECHNICAL FIELD

The present invention relates to an infant care apparatus comprising a bed on which an infant is to be laid, and a heater configured radiate heat rays to the bed, wherein the heat rays are radiated from the heat radiation opening of the heater to the bed.

BACKGROUND OF THE INVENTION

U.S. No. 2005/0070756A1 discloses, as an infant care apparatus, an open type incubator serving also as a closed type incubator (to be referred to as "the infant care apparatus according to the patent reference" hereinafter), which includes an infant mat which is substantially rectangular when seen from the top and on which an infant is to be laid, and a heater which can radiate heat rays to the upper surface of the mat, and wherein the heat rays are radiated from the heat radiation opening of the heater to the upper surface of the infant mat. In this infant care apparatus according to the patent reference, the heater is fixed obliquely above the infant mat and cannot move up and down. In contrast to this, the top hood is configured to move up and down relative to the infant mat. The top hood includes an opening for the passage of heat rays and a pair of left and right doors which can open and close the opening for the passage of heat rays. When the infant care apparatus shifts from the closed type state to the open type state, the top hood moves up to make the heater relatively come into contact with the pair of left and right doors. This makes the pair of left and right doors pivot forward and downward to open. The heat rays radiated outward from the heat radiation opening of the heater pass through the heat ray passage opening of the top hood and radiate the upper surface of the infant mat.

In the infant care apparatus according to the patent reference, which is configured in the above manner, the heater relatively comes into contact with the pair of left and right doors of the top hood to push open the pair of left and right doors downward. For this reason, an infant lying on the upper surface of the mat or people surrounding the infant care apparatus have feelings that rough operation is performed above the mat. This is undesirable for the infant and the surrounding people in terms of mental health. In addition, since the heater radiates heat rays while it is located inside the top hood, heat tends to stay inside the top hood. For this reason, when the infant care apparatus is to be switched to the closed type state and used while it is used in the open type state, the infant lying on the upper surface of the mat may be overheated, even if temporarily, by the heat staying inside the top hood and the remaining heat of the heater. Furthermore, since the heater is always located at a high position, when moving the infant care apparatus in the closed type state inside a hospital or the like, the operator needs to take the greatest care to prevent the heater from hitting or hooking on something. Moreover, since the swing of the heater located at a high position is amplified during such movement, the overall infant care apparatus may unstably swing. This swing is therefore transferred as an uncomfortable swing to the infant lying on the upper surface of the mat.

SUMMARY OF THE INVENTION

The present invention is to effectively solve the drawbacks as described above of the infant care apparatus according to the patent reference with a comparatively simple arrangement.

The present invention relates to an infant care apparatus comprising a bed such as an upper surface of a mat on which an infant is to be laid, and a heater configured to radiate heat rays to the bed, wherein the heat rays are radiated from a heat radiation opening of the heater to the bed, wherein the heat radiation opening is configured to change a direction thereof from a first state in which the heat radiation opening substantially faces the bed to a second state in which the heat radiation opening does not substantially face the bed. The present invention can be applied to an open type incubator serving also as a closed type incubator, an open type incubator, a resuscitation treating apparatus, and other types of infant care apparatuses, and can be optimally applied to an open type incubator serving also as a closed type incubator. According to the present invention, when the heater is not used, deflecting the heat radiation opening of the heater from the first state to the second state will eliminate the possibility that the remaining heat of the heater is transferred to the infant laying on the bed. There is therefore no possibility that the infant will be unnecessarily overheated. Unlike the case of the infant care apparatus according to the parent reference, there is no need to operate the heater and the like of the infant care apparatus in such a manner that the infant lying on the bed and surrounding people have feelings that rough operation is performed. This will keep the infant and the surrounding people free from adverse effects in terms of mental health.

According to the first aspect, the present invention can be configured such that the heater is configured to move up and down, the heat radiation opening is held in the first state when the heater is at an upper position, and the heat radiation opening is held in the second state when the heater is at a lower position. According to the first aspect, when the heater is not used, the heater can be held at the lower position. This prevents the heater from hitting or hooking on something while the infant care apparatus with the heater being held at the lower position is moved inside a hospital or the like. In addition, there is no possibility that the swing of the heater will be amplified and the overall infant care apparatus will unstably swing during such movement. There is therefore no possibility that an uncomfortable swing will be unnecessarily transferred to the infant lying on the bed.

According to the second aspect, the present invention can be configured such that the heater is configured to pivot forward and backward about a fulcrum to change the direction of the heat radiation opening from the first state to the second state. According to the second aspect, the present invention can reliably obtain the above effects with a comparatively simple arrangement.

According to the third aspect, the present invention can be configured such that when the heat radiation opening is held in the first state, a tilt angle by which the heat radiation opening tilts upward from a rear end side thereof to a front end side thereof with respect to a horizontal direction falls within a range of 12° to 50° (preferably 16° to 38° and more preferably 20° to 32°). According to the fourth aspect, the present invention can be configured such that when the heat radiation opening is held in the second state, a tilt angle by which the heat radiation opening tilts downward from a rear end side thereof to a front end side thereof with respect to a horizontal direction falls within a range of 45° to 180° (preferably 60° to 120° and more preferably 70° to) 110°. In addition, according to the fifth aspect, the present invention can be configured such that a deflection angle of the heat radiation opening set when the heat radiation opening changes a direction thereof from the first state to the second state falls within a range of 60° to 220° (preferably 80° to 160° and more preferably 90° to 140'). According to the third, fourth and fifth aspects, when the heater is used, an infant can be properly warmed by the heater. When the heater is not used, since the heat radiation opening of the heater faces substantially downward or the opposite side to the bed, there is no possibility that the infant lying on the bed or the surrounding people will be unnecessarily overheated by the remaining heat of the heater.

According to the sixth aspect, the present invention can be configured such that the infant care apparatus further comprises a heater strut to which the heater is attached, wherein the heater strut includes a stationary strut and a movable strut which is configured to move up and down with respect to the stationary strut and to which the heater is attached, the heat radiation opening is held in the second state when the movable strut is at a lower position, and the heat radiation opening changes a direction thereof from the second state to the first state when the movable strut moves forward to an upper position. According to the sixth aspect, it is possible to obtain the same effect as that obtained according to the fifth aspect with a comparatively simple arrangement.

According to the seventh aspect, the present invention can be configured such that the infant care apparatus further comprises a top hood configured to move up and down, the infant care apparatus is configured to serve as a closed type incubator when the top hood is held at a lower position, the infant care apparatus is configured to serve as an open type incubator when the top hood is held at an upper position, heater components including the heater do not protrude from an elevation path of top hood components including the top hood when the heat radiation opening is held in the second state, and the heater components protrude from the elevation path of the top hood components when the heat radiation opening is held in the first state. In this case, the heater components can include the heater and at least one additional part of the heater which moves up and down accompanying the heater. Furthermore, the top hood components can include the top hood and at least one additional part of the top hood which moves up and down accompanying the top hood. According to the seventh aspect, since the single infant care apparatus can be used in the closed type state and the open type state, it is possible to diagnose, treat, or care the infant lying on the bed in a preferable state. When the infant care apparatus is used in the open type state, the top hood can be located above the heater. This makes it possible to radiate heat rays from the heater to the bed without being hindered by the top hood in spite of the use of a comparatively simple arrangement.

The above, and other, objects, features and advantages of this invention will become readily apparent from the following detailed description thereof which is to be read in connection with the accompanying drawings.

DETAILED DESCRIPTION OF THE INVENTION

Figure 1:
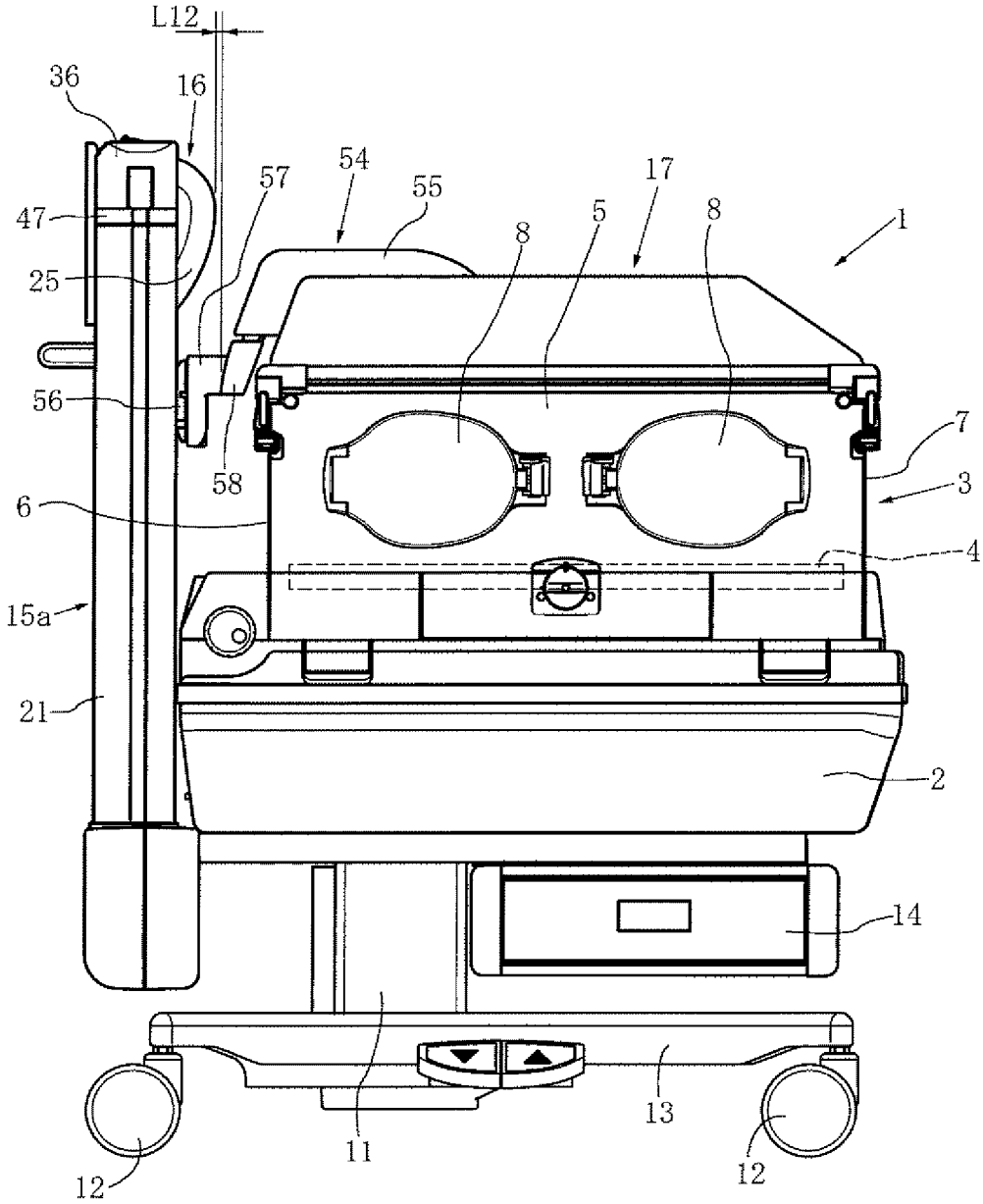
FIG. 1 is a side view of the front side of an open type incubator serving also as a closed type incubator according to an embodiment of the present invention in the closed type state.

One embodiment in which the present invention is applied to an open type incubator serving also as a closed type incubator will be described in "1. Schematic Arrangement of Incubator as a Whole", "2. Arrangement of Heater", "3. Arrangement of Pivot Driving Mechanism for Heater", "4. Operation of Pivot Driving Mechanism for Heater", "5. Mutual Relationship between Heater and Top Hood" and "6. Effects of Incubator" with reference to the accompanying drawings.

1. Schematic Arrangement of Incubator as a Whole

As shown in FIGS. 1 to 6, an incubator 1 includes a base 2 which is, e.g., substantially rectangular when seen from the top, and an enclosure 3 which is, e.g., substantially rectangular parallelepiped and stands along substantially the outer circumference of the base 2. A mattress tray (not shown) is placed on the base 2. A thin sheet (not shown) is spread, if necessary, on an infant mat 4 disposed on the mattress tray, and then an infant such as a premature infant is laid on the sheet and is, for example, diagnosed, treated, and cared. The enclosure 3 may be substantially transparent as a whole, and can include a front wall 5, a rear wall (not shown), a head-side (in other words, proximal-end-side) wall 6 and a leg-side (in other words, distal-end-side) wall 7. The front wall 5, the rear wall, the head-side wall 6 and the leg-side wall 7 constitute a surrounding frame portion which can be substantially rectangular when seen from the top. The front wall 5, the rear wall, the leg-side wall 7 and the like constitute a fence or treatment window. The walls 5 and 7 can be opened by being made to pivot downward or being moved downward substantially linearly to allow a doctor or the like to, for example, diagnose and treat the infant from an arbitrary direction. For example, a pair of left and right servicing windows 8 may be arranged in each of the front wall 5, the rear wall and the like. When the front wall 5, the rear wall and the leg-side wall 7 are completely opened, as described above, the incubator 1 can be used as a resuscitation treating apparatus.

The base 2 shown in FIGS. 1 to 6 is attached to and supported by a frame (not shown) extending substantially in the horizontal direction. A main strut 11 supports the frame. The main strut 11 is attached to and supported by a base 13 having, e.g., four arms respectively having wheels 12. Furthermore, a drawer 14 that can be drawn out toward the front or rear side can be attached to the base 2.

Figure 2:
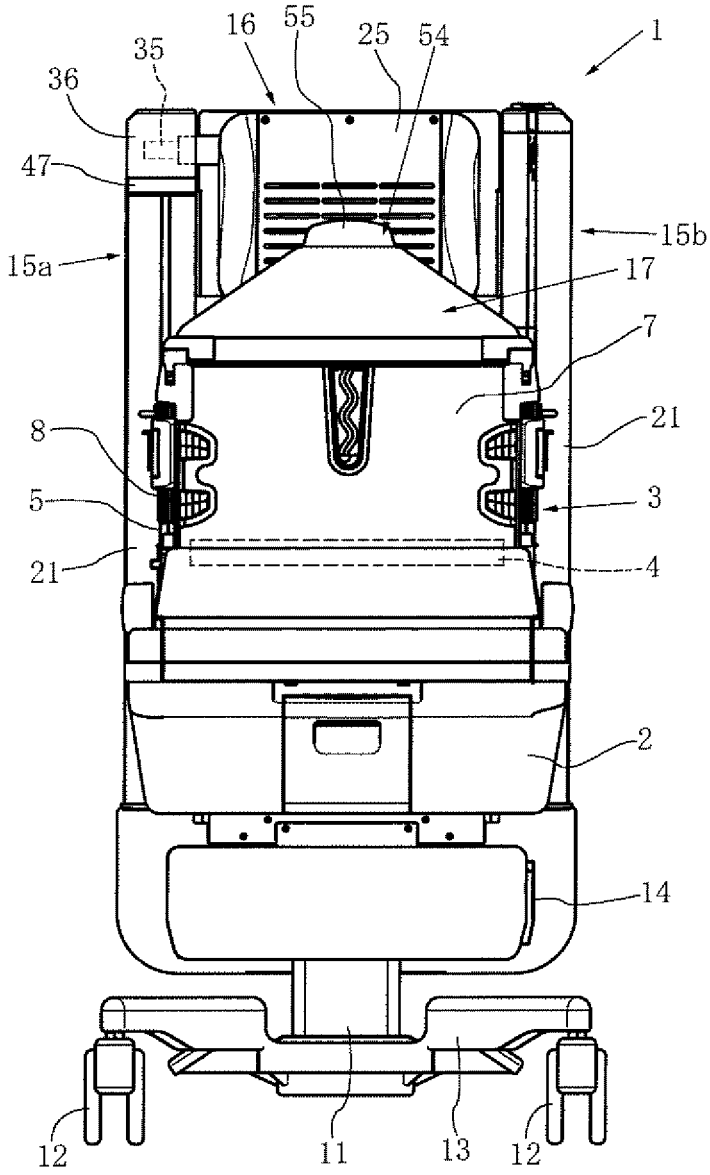
FIG. 2 is a front view of the incubator shown in FIG. 1 in the closed type state as in FIG. 1.
Figure 3:
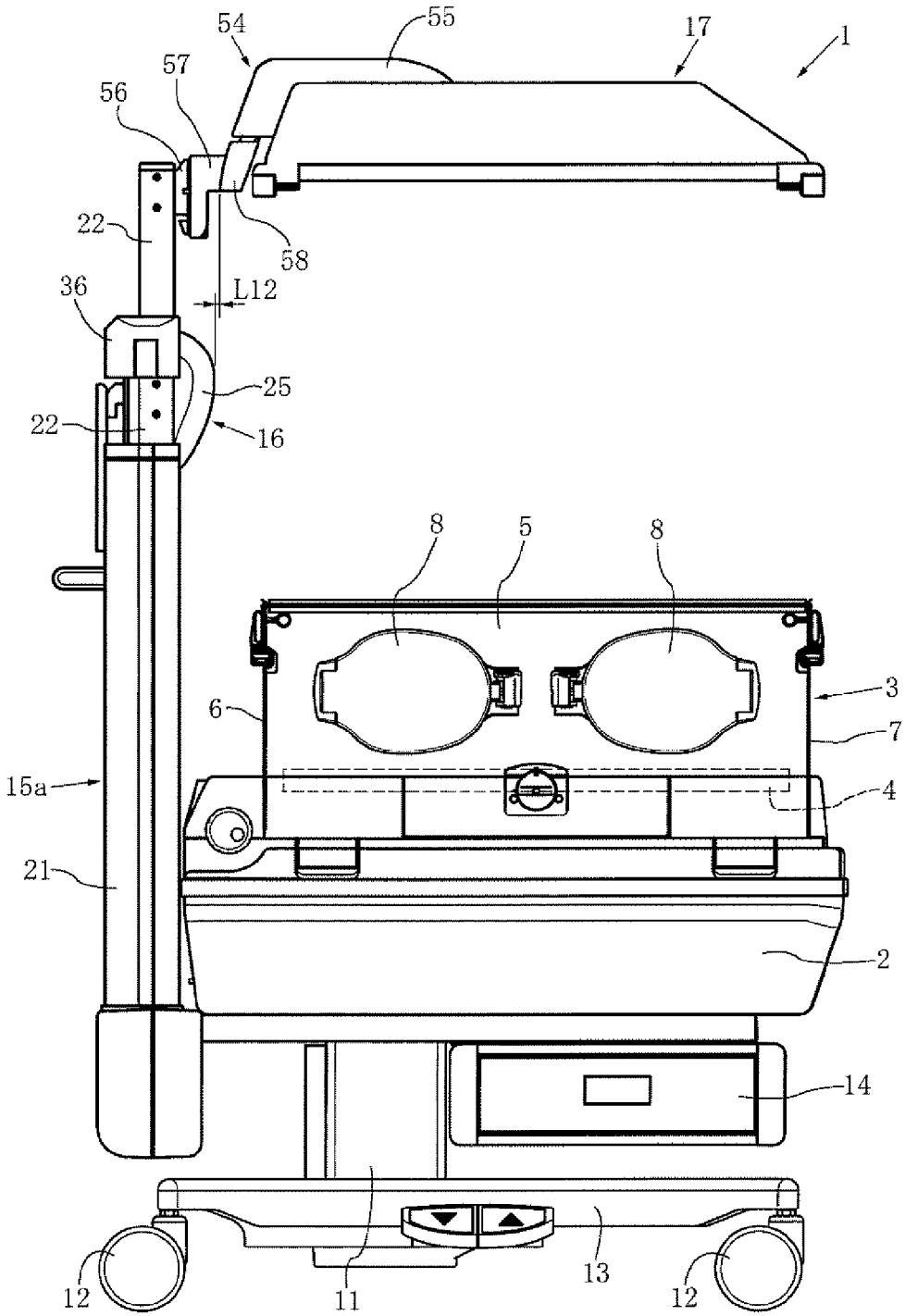
FIG. 3 is a side view of the front side of the incubator shown in FIG. 1 in the first transition stage in which the incubator is shifting from the closed type state shown in FIG. 1 to the open type state.
Figure 4:
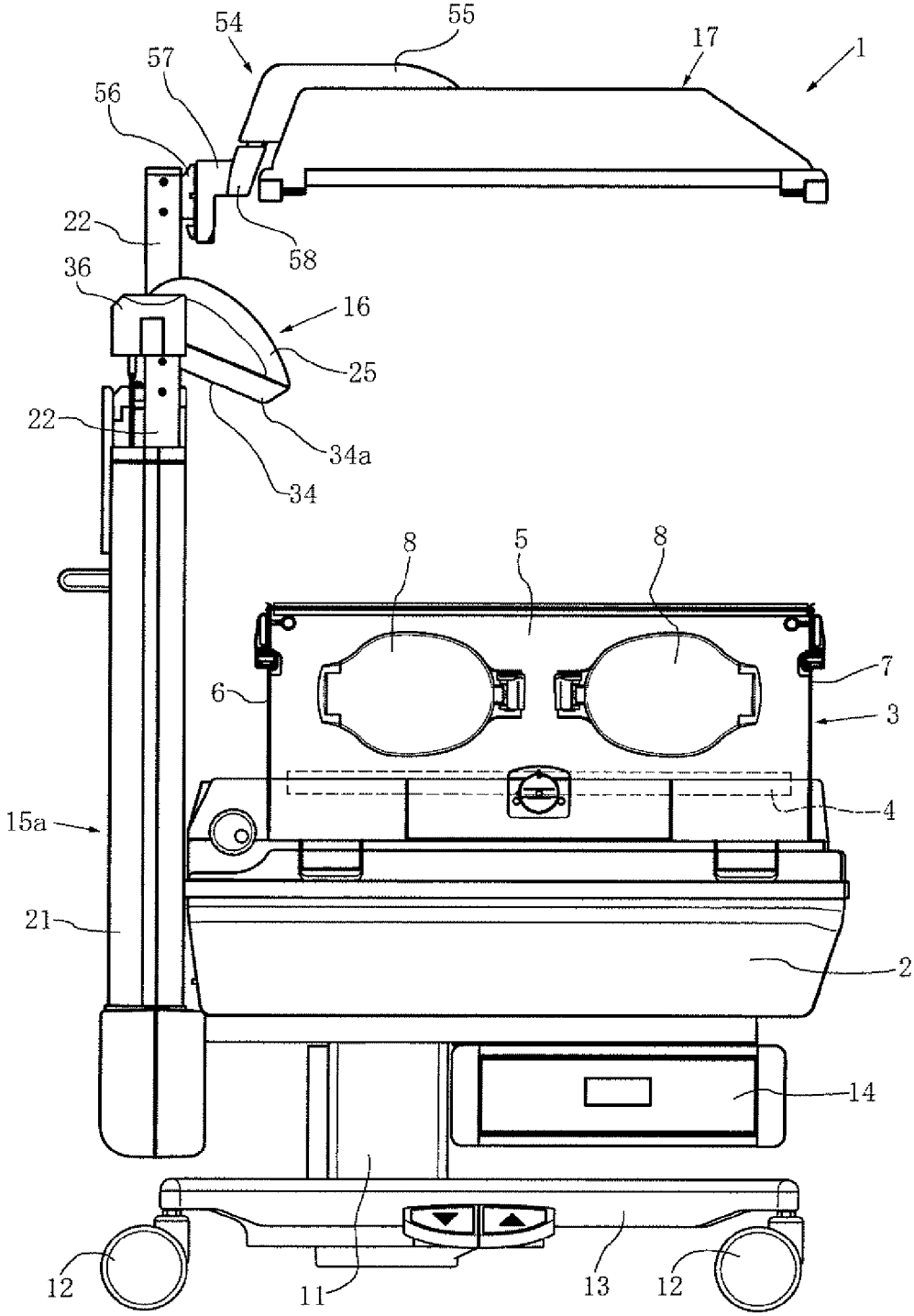
FIG. 4 is a side view of the front side of the incubator shown in FIG. 3 in the second transition stage in which the incubator is further shifting from the first transition stage shown in FIG. 3 to the open type state.

A pair of left and right sub-struts 15*a* and 15*b* which may be substantially symmetric with each other in FIG. 2 are attached to and supported by the frame attached to and supported by the main strut 11 shown in FIGS. 1 to 6. The pair of left and right sub-struts 15*a* and 15*b* are arranged outside the head-side wall 6 while they are spaced apart from the enclosure 3 toward the head side. The enclosure 3 further includes a top hood 17, as shown in FIGS. 1 and 2. A heater 16 is attached to and supported by, for example, the left heater sub-strut 15*a* of the pair of left and right sub-struts 15*a* and 15*b* in FIG. 6 such that the heater 16 is located obliquely above the head side of a center 4*a* of the mat 4, as shown in FIG. 7. The top hood 17 is attached to and supported by, for example, the right top hood sub-strut 15*b* in FIG. 6. In this case, the top hood 17 may have a substantially quadrangular truncated pyramidal shape and so on, and may be a hollow member with the lower surface being open. The enclosure 3 therefore includes the surrounding frame and the top hood 17 which can selectively cover the upper end opening of the surrounding frame. In the incubator 1 in the closed type state shown in FIGS. 1 and 2, the enclosure 3 is formed into a very small hut-like shape.

Figure 5:
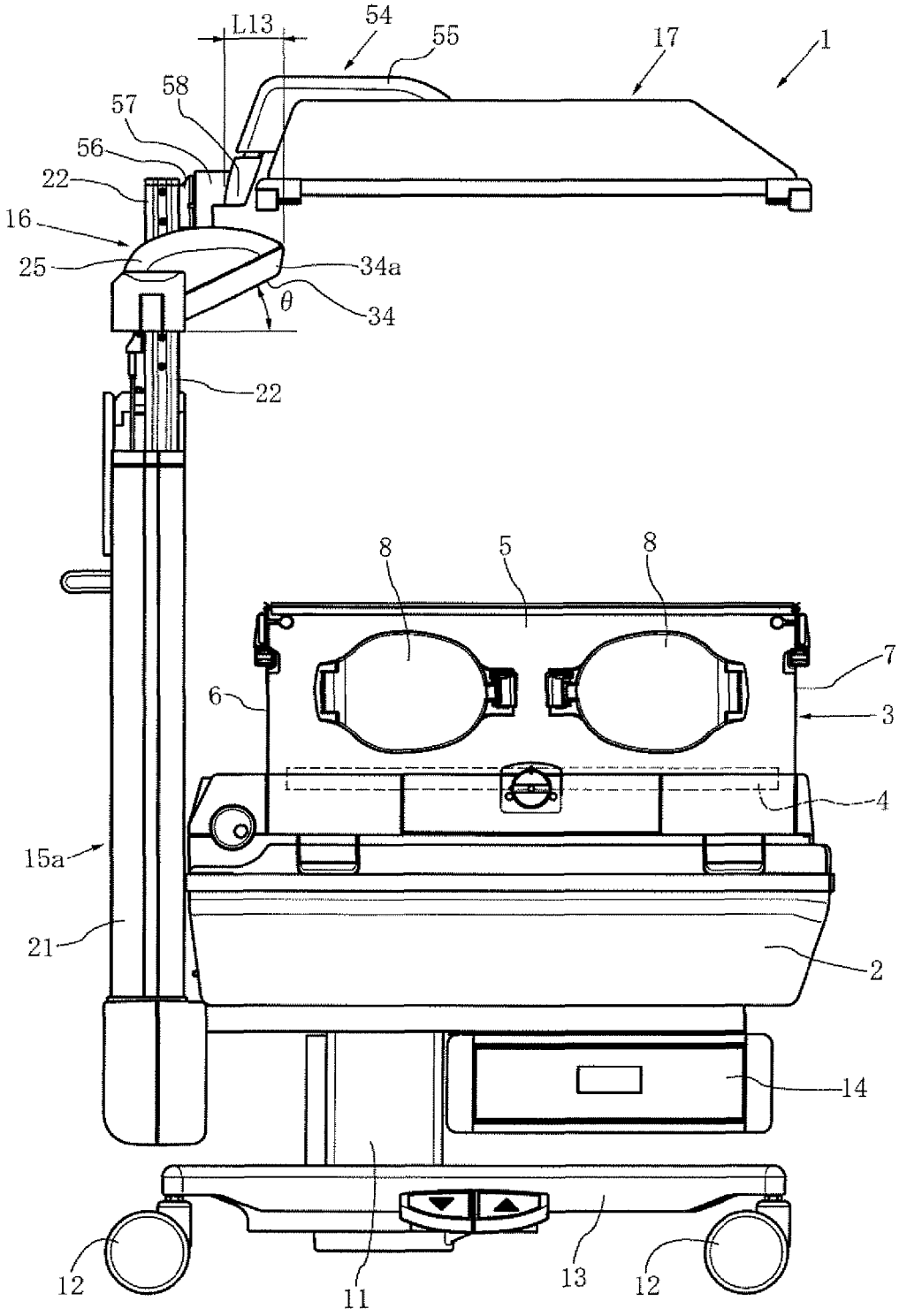
FIG. 5 is a side view of the front side of the incubator shown in FIG. 1 in the open type state.
Figure 6:
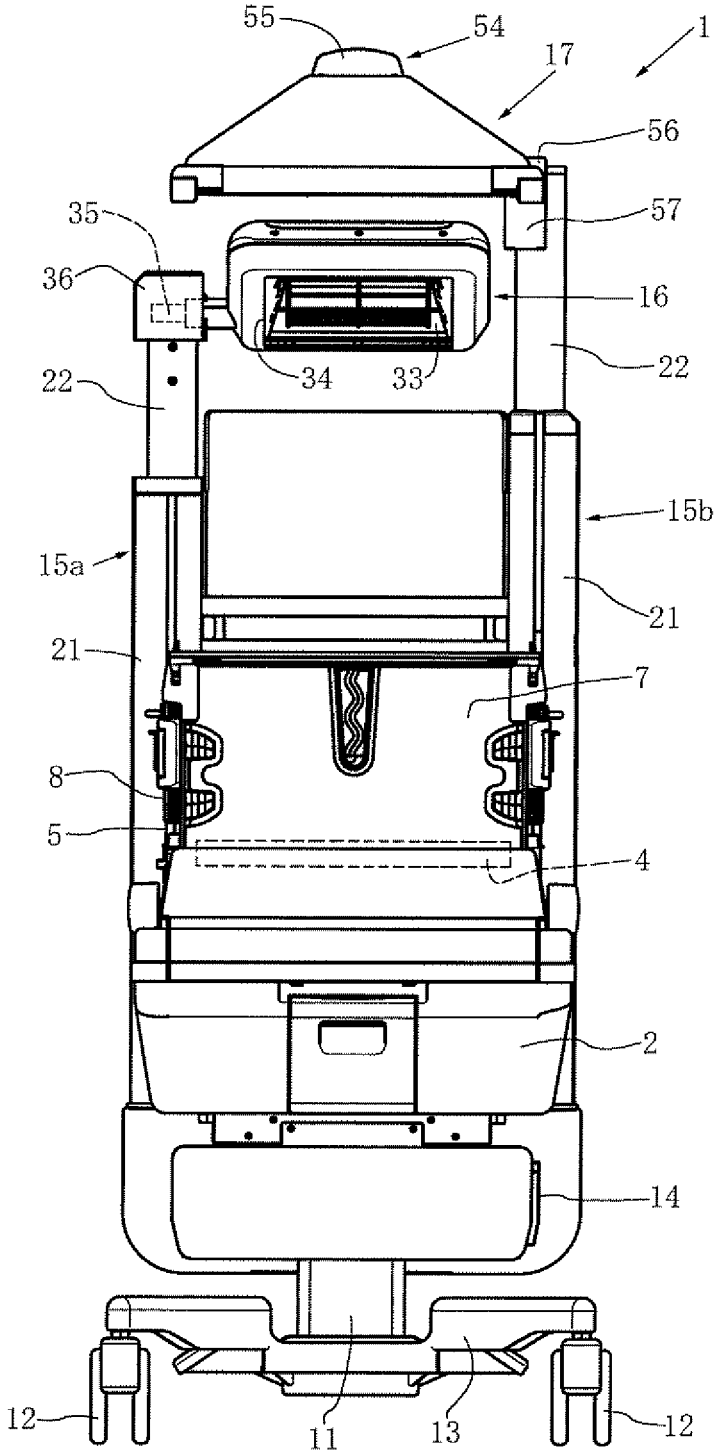
FIG. 6 is a front view of the incubator shown in FIG. 5 in the open type state as in FIG. 5.
Figure 7:
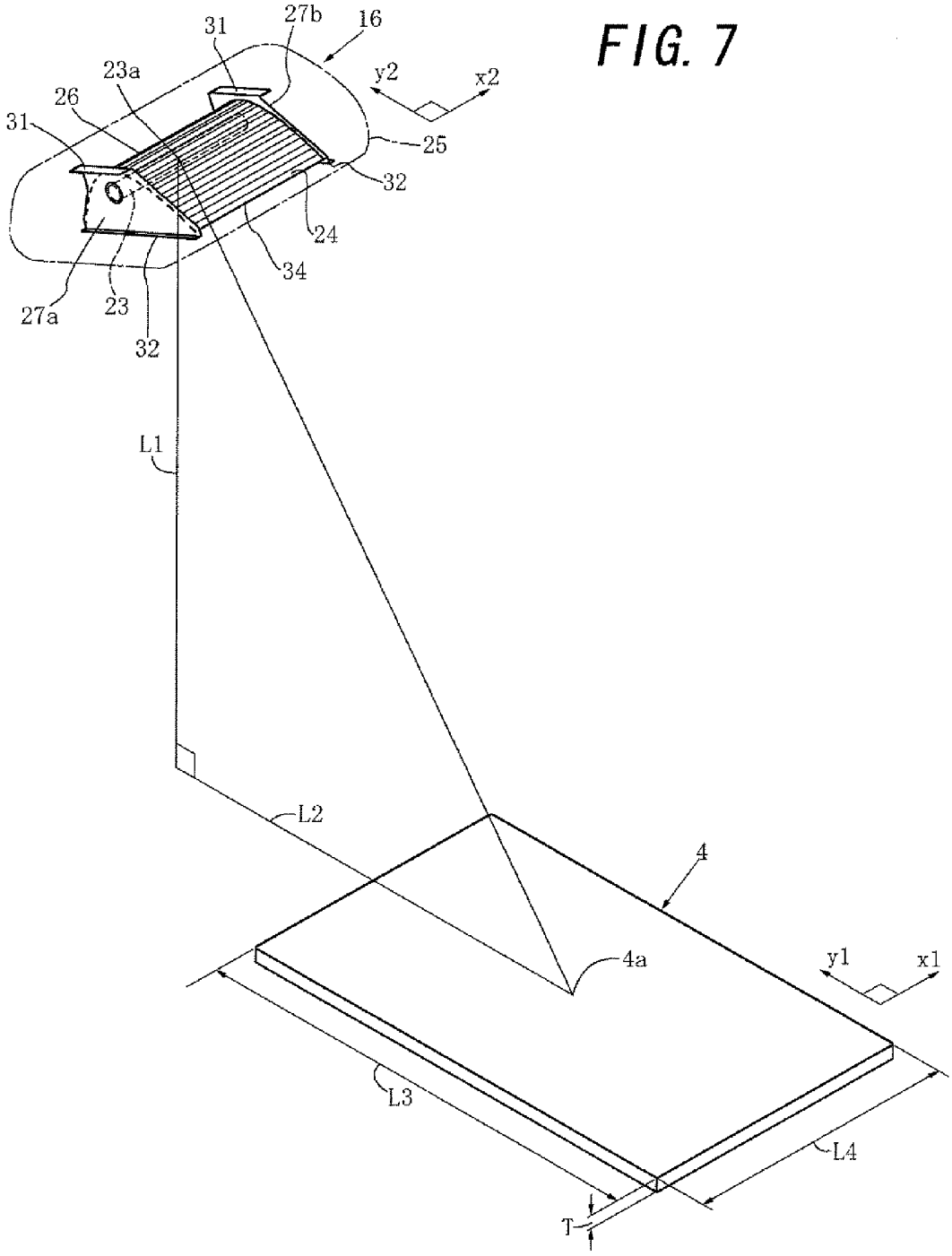
FIG. 7 is a schematic perspective view showing the mutual positional relationship between a heater and a mat in the incubator in the open type state shown in FIG. 5.
Figure 8A:
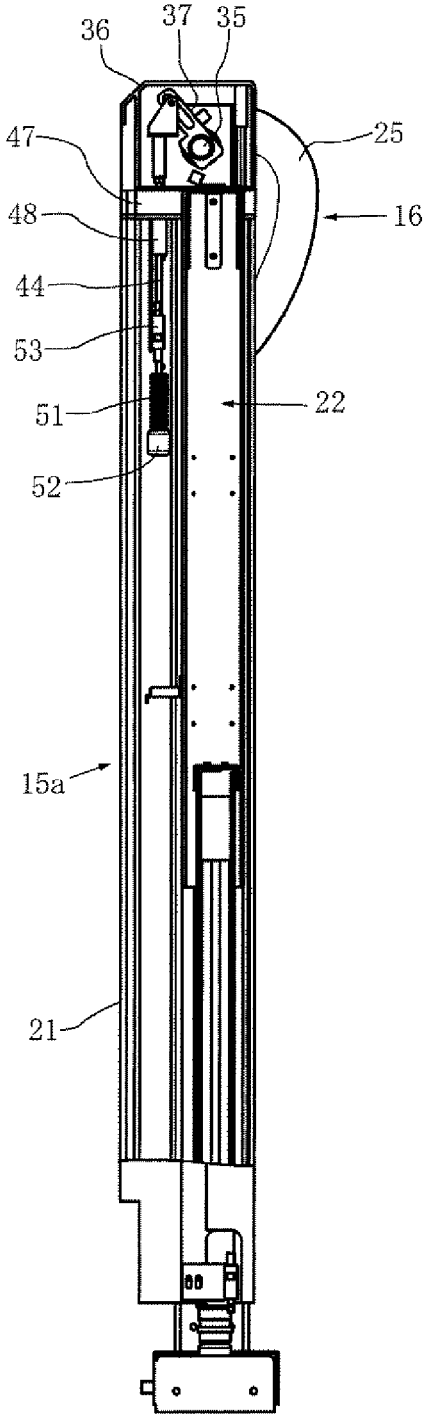
FIG. 8A is a partial sectional view schematically showing the heater and its support mechanism in the incubator in the closed type state shown in FIG. 1.
Figure 8B:
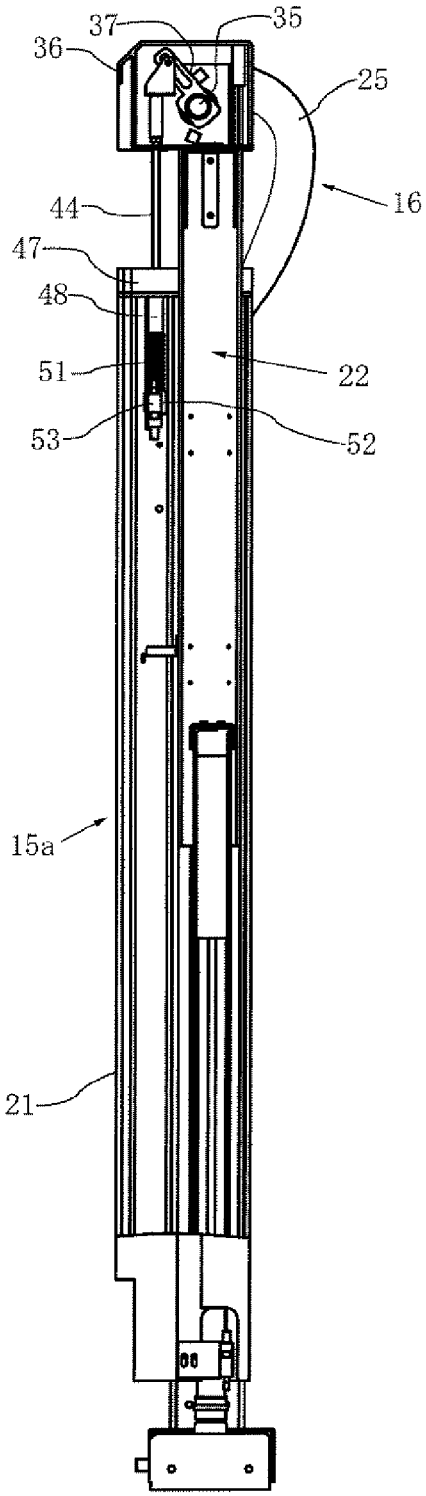
FIG. 8B is a partial sectional view schematically showing the heater and its support mechanism in the incubator in the first transition stage shown in FIG. 3.
Figure 9A:
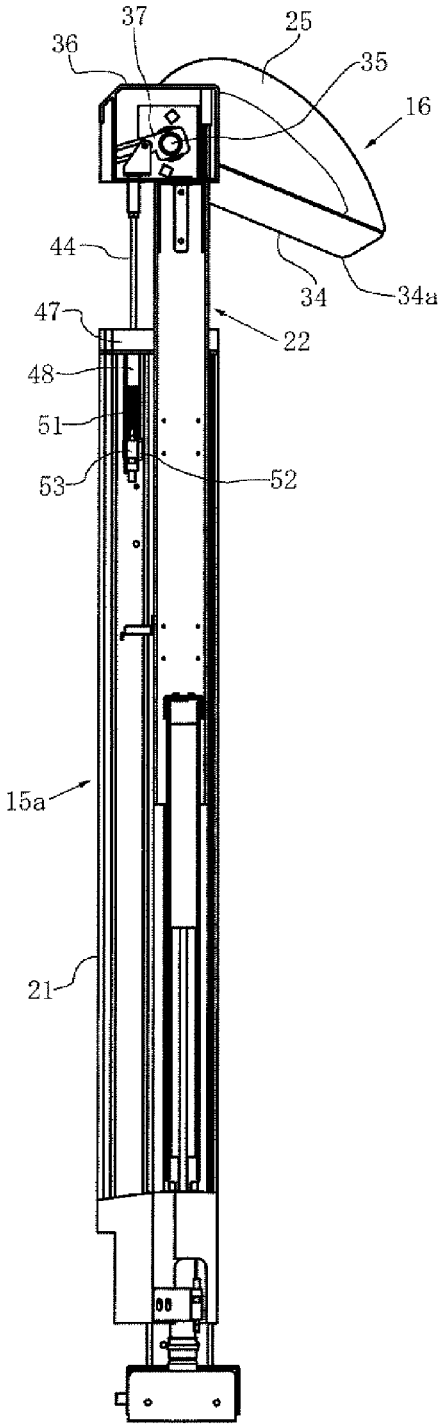
FIG. 9A is a partial sectional view schematically showing the heater and its support mechanism in the incubator in the second transition stage shown in FIG. 4.
Figure 9B:
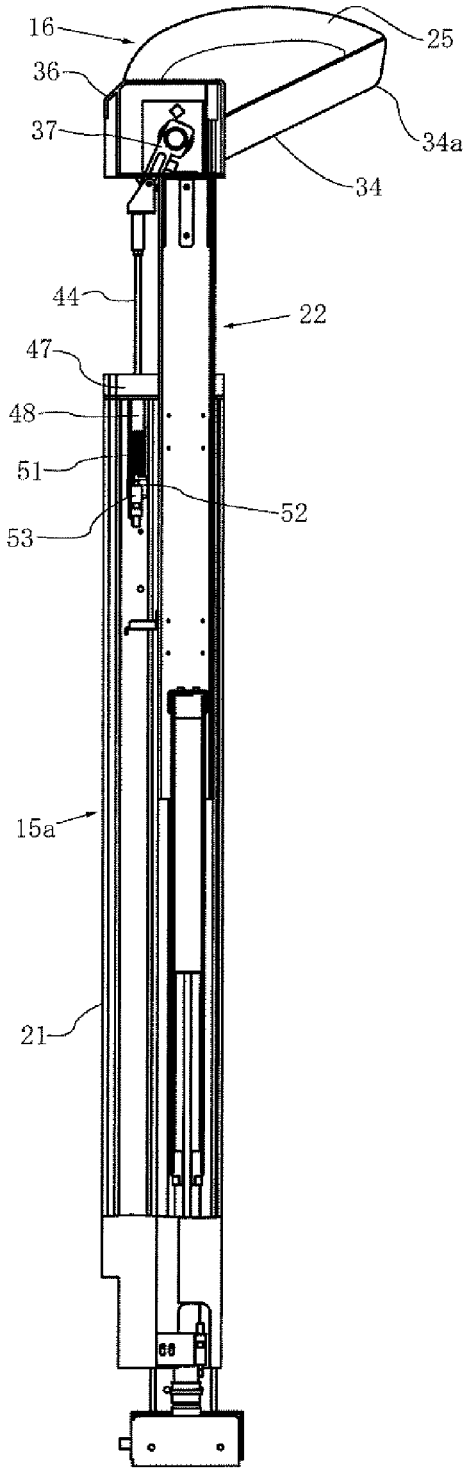
FIG. 9B is a partial sectional view schematically showing the heater and its support mechanism in the incubator in the open type state shown in FIG. 5.

Each of the heater sub-strut 15*a* and the top hood sub-strut 15*b* shown in FIGS. 1 to 6 is formed of a stationary strut 21 and a movable strut 22. The lower end portions of the stationary struts 21 of the pair of left and right sub-struts 15*a* and 15*b* are attached to and supported by the frame. The pair of movable struts 22 each is configured to be reciprocally driven (in other words, driven to be stretchable with respect to the corresponding stationary strut 21) in the vertical direction by an elevation driving mechanism such as a driven gear, a driving chain, a driving gear, an electric motor and so on (neither is shown). When the top hood 17 moves to the upper position, as shown in FIGS. 5 and 6, the incubator 1 serves as an open type incubator. When the top hood 17 moves to the lower position, as shown in FIGS. 1 and 2, the incubator 1 serves as a closed type incubator. Assume that the incubator 1 serves as the closed type incubator. When the heater 16 is in an operable state (in which it radiates only a small amount of heat rays), it may stay at the upper position, in the same manner as in the case shown in FIGS. 5 and 6. When the heater 16 is in a non-operable state, it may move to the lower position shown in FIGS. 1 and 2.

The arrangements of the heater 16 and its pivot driving mechanism, and the mutual relationship between the heater 16 and the top hood 17 will be described in detail in the next item (i.e., "2. Arrangement of Heater") and the subsequent items. Therefore, a repeated detailed description of the arrangements and the mutual relationship will be omitted in this item. Basically, the arrangement of the incubator 1 may be a known one except for the arrangements of the heater 16 and its pivot driving mechanism, and the mutual relationship between the heater 16 and the top hood 17. The details of the arrangement of the incubator 1 are not the gist of the present invention except for the arrangements of the heater 16 and its pivot driving mechanism, and the mutual relationship between the heater 16 and the top hood 17. For this reason, the arrangement of the incubator 1 which is not the gist of the present invention will not be illustrated in detail in the drawings or described in detail in this description.

2. Arrangement of Heater

As shown in FIG. 7, the heater 16 is formed of a substantially rod-like heat generator 23, a reflector 24 and a hood 25. As shown in FIGS. 5 and 6, the hood 25 is pivotally attached and fixed to a region including the upper end portion of the movable strut 22 of the heater sub-strut 15*a* and its vicinity. The rod-like heat generator 23 may be one obtained by covering a ceramic heat-generating element with a stainless steel pipe having a substantially cylindrical shape, e.g., a substantially circular cylindrical shape, or one obtained by accommodating a heat-generating element formed of a resistor coil wire such as a nichrome wire in a quartz tube having a substantially cylindrical shape, e.g., a substantially circular cylindrical shape. For example, the rod-like heat generator 23 may have a diameter of about 15 mm and a length of about 180 mm. For example the hood 25 may be a molded product made of a heat-resistant synthetic resin.

As shown in FIG. 7, the reflector 24 may be formed of a substantially semi-prismatic upper reflecting plate portion 26 in which a lower surface corresponding to a chord is open, and a pair of left and right reflecting plate portions 27*a* and 27*b*. Each of the left and right reflecting plate portions 27*a* and 27*b* has upper and lower attaching target portions 31 and 32. Each of the left and right reflecting plate portions 27*a* and 27*b* has, at its lower end portion, left and right band-like projections 32 to prevent convection heat from flowing into the hood 25. The gap between the left and right reflecting plate portions 27*a* and 27*b* may be, e.g., about 200 mm.

The inner surfaces (in other words, reflecting surfaces) of the left and right reflecting plate portions 27*a* and 27*b* shown in FIG. 7 may be substantially flat. The inner surfaces of the left and right reflecting plate portions 27*a* and 27*b* are respectively provided with sockets (not shown) for the rod-like heat generator 23. The two end portions of the rod-like heat generator 23 are attached and fixed to the pair of left and right sockets such that power can be supplied to the rod-like heat generator 23. While the left and right reflecting plate portions 27*a* and 27*b* are accommodated in the hood 25, the attaching target portions 31 of the left and right reflecting plate portions 27*a* and 27*b* are respectively attached and fixed to left and right attaching portions (not shown) provided to the hood 25. The reflector 24 (in other words, the upper reflecting plate portion 26 and left and right reflecting plate portions 27*a* and 27*b*) may be made of aluminum (for example, aluminum with a purity of 99% or more). The reflecting surfaces of the reflecting plate portions 26*a*, 27*a* and 27*b* may have heat ray reflectances of, e.g., about 95% or more.

As shown in FIG. 7, a distance L1 from a center 23*a* of the rod-like heat generator 23 of the heater 16 at the upper position shown in FIGS. 5 and 6 to the upper surface of the mat 4 in the vertical direction is about 850 mm in the embodiment shown in the drawings. A distance L2 from the center 23*a* of the rod-like heat generator 23 to a center 4*a* of the mat 4 in the horizontal direction (in other words, when seen from the top) is about 665 mm in the embodiment shown in the drawings. A length L3 of the mat 4 in a longitudinal direction (in other words, a direction from the head side toward the leg side) y1 is about 635 mm in the embodiment shown in the drawings. A length L4 of the mat 4 in a lateral direction (in other words, the horizontal direction) x1 is about 375 mm in the embodiment shown in the drawings. Also, a thickness T of the mat 4 is about 20 mm in the embodiment shown in the drawings.

As shown in FIG. 7, when seen from the top, the center 23*a* of the rod-like heat generator 23 and the center 4*a* of the mat 4 are disposed substantially on one straight line in the longitudinal direction (in other words, the direction from the head side toward the leg side) y1 of the mat 4 in the embodiment shown in the drawings. An axial direction x2 of the rod-like heat generator 23 is substantially parallel to a lateral direction x1 of the mat 4. A reflecting surface 33 (see FIG. 6) of the upper reflecting plate portion 26 is substantially parallel to the axial direction of the rod-like heat generator 23. The front portion and rear portion of the reflecting surface 33 of the upper reflecting plate portion 26 extend while they are bent substantially downward with respect to a horizontal direction y2 which is substantially perpendicular to the axial direction x2 of the rod-like heat generator 23. The inner surface 33 covers substantially the upper surface side of the rod-like heat generator 23 from above.

Figure 13:
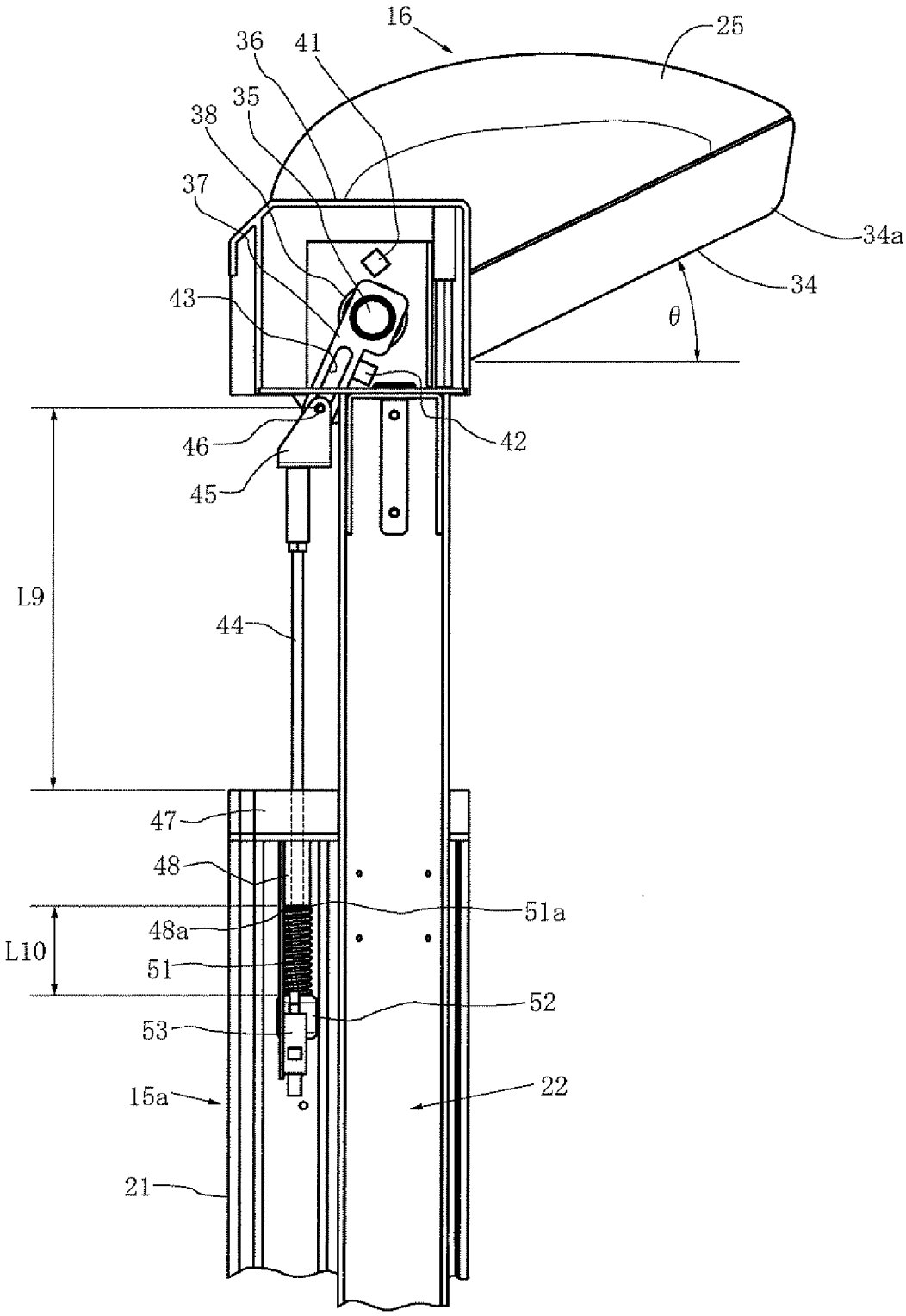
FIG. 13 is a partially enlarged sectional view schematically showing the main part in FIG. 98.

As shown in FIG. 7, the outer surface and inner surface of the upper reflecting plate portion 26 substantially form a semi-prismatic shape in which a lower surface corresponding to a chord is open. For example, such upper reflecting plate portion 26 can be formed by molding a mirror-finished aluminum plate by, e.g., pressing. A tilt angle θ of a heat radiation opening 34 of the reflector 24 (in other words, the hood 25, and further in other words, the heater 16) of the heater 16 located at the upper position shown in FIGS. 5 and 6 is about 26° in the embodiment shown in the drawings. In this case, as shown in FIGS. 5 and 13, the tilt angle θ indicates the angle by which the heat radiation opening 34 tilts upward from its rear end side to the upper side toward a front end 34*a* with respect to the horizontal direction. In general, from a practical viewpoint, the tilt angle θ preferably falls within a range of 12° to 50°, more preferably 16° to 38° and most preferably 20° to 32°.

3. Arrangement of Pivot Driving Mechanism for Heater

In the pivot driving mechanism for the heater, the hood 25 of the heater 16 is pivotally supported on a substantially box-like upper end portion 36 of the movable strut 22 for the heater 16 through a support shaft 35, one end of which integrally is coupled to the hood 25, as shown in, for example, FIGS. 6, 8A, 8B, 9A, 9B and 10. An actuation lever 37 for making the heater 16 pivot is integrally coupled to the support shaft 35 as an additional part of the heater 16. The upper end portion 36 is provided with a stopper 41 for backward pivoting which restricts the backward pivoting position of the actuation lever 37 and a stopper 42 for forward pivoting which restricts the forward pivoting position of the actuation lever 37. A bearing 38 which pivotally supports the support shaft 35 is disposed on the upper end portion 36.

As shown in FIGS. 10 to 13, the actuation lever 37 has a long hole 43. An engaging pin 46 provided on an upper end portion 45 of the control rod 44 extends through the long hole 43. The control rod 44 is supported by a substantially cylindrical guide portion 48 protruding substantially downward from an upper end portion 47 of the stationary strut 21 so as be reciprocally movable in substantially the vertical direction (in other words, substantially linear). A region including the lower end portion of the control rod 44 and its vicinity relatively extend through a coil spring 51. A switch operator 52 serving also as a means for preventing the removal of the coil spring 51 is provided on the lower end portion (in other words, a portion below the coil spring 51) of the control rod 44. The switch operator 52 can on/off-control a switch 53 provided on the stationary strut 21.

4. Operation of Pivot Driving Mechanism for Heater

Figure 10:
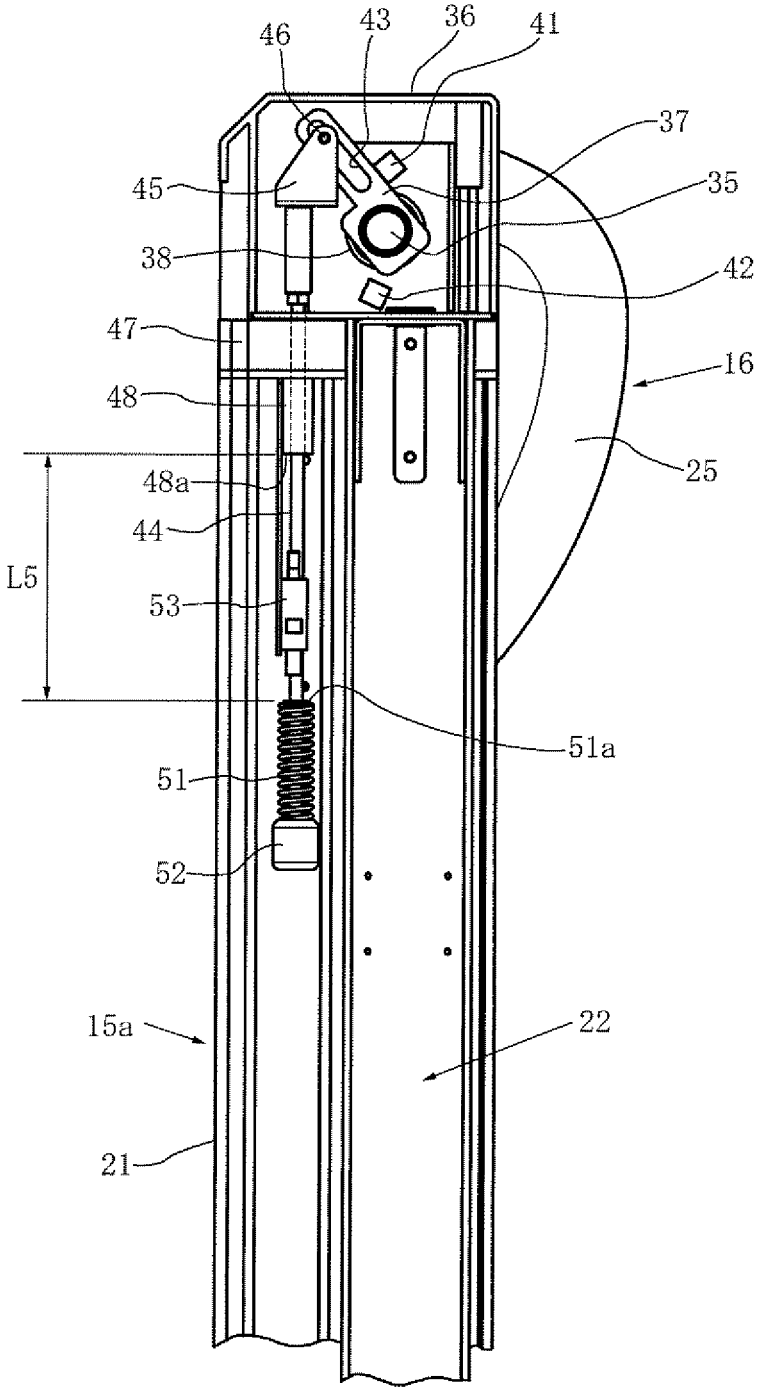
FIG. 10 is a partially enlarged sectional view schematically showing the main part in FIG. 8A.
Figure 11:
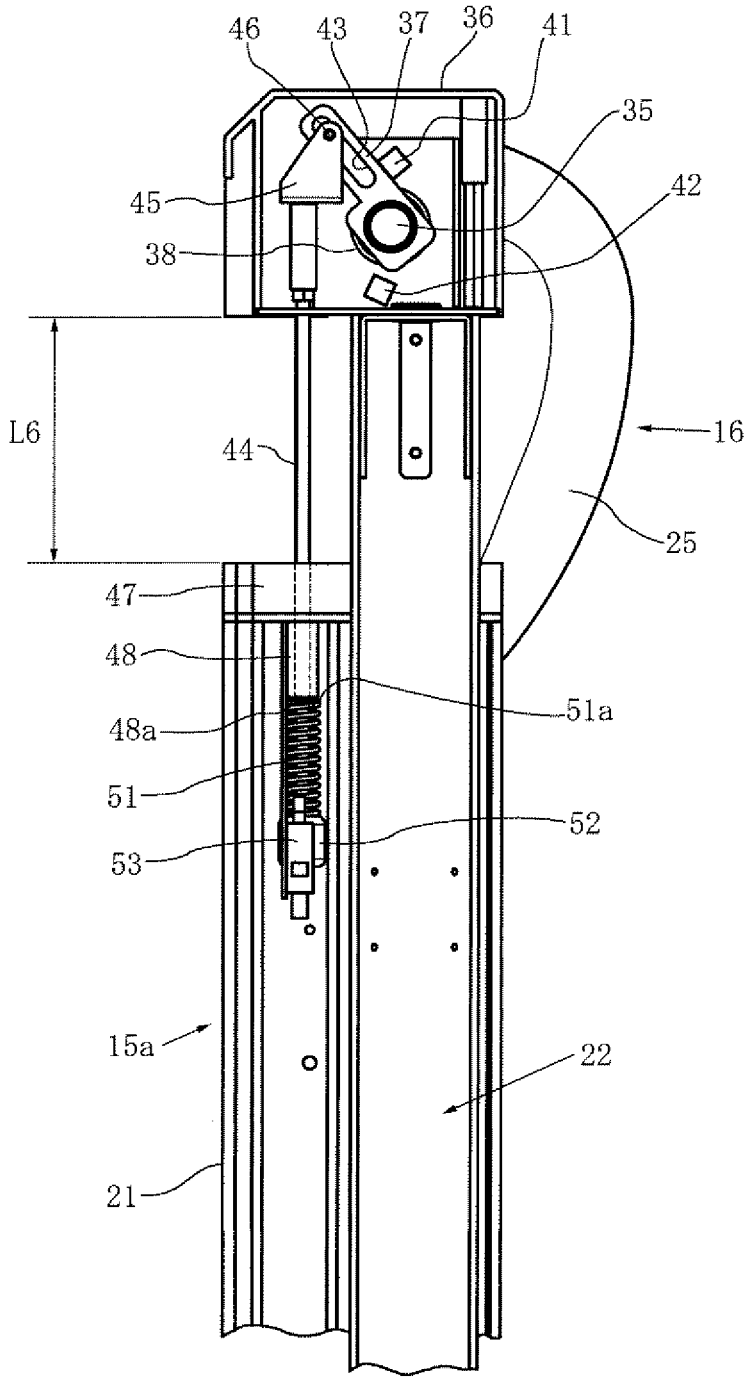
FIG. 11 is a partially enlarged sectional view schematically showing the main part in FIG. 88,7

In the pivot driving mechanism for the heater, when the heater 16 is in a non-operable state (in other words, in an accommodated state) at the lower position as shown in FIGS. 1, 2, 8A and 10, an upper end Sla of the coil spring 51 is spaced apart from the lower end of the guide portion 48 by a distance L5 (see FIG. 10). In the state shown in FIG. 10, even if the movable strut 22 moves upward by a distance equal to or less than the distance L5, the heater 16 does not start pivoting forward. As shown in FIG. 11, when the movable strut 22 moves upward by the distance L5, the upward movement of the box-like upper end portion 36 will shift the heater 16 and its support mechanism (in other words, the pivot driving mechanism) to the first transition stage shown in FIG. 11. As the lower surface of the upper end portion 36 and the upper surface of the upper end portion 47 of the stationary strut 21 which are substantially in contact with each other are separated from each other by a distance L6 substantially equal to the distance L5 as shown in FIG. 11, the upper end 51*a* of the coil spring 51 substantially comes into contact with the lower end of the cylindrical guide portion 48.

Figure 12:
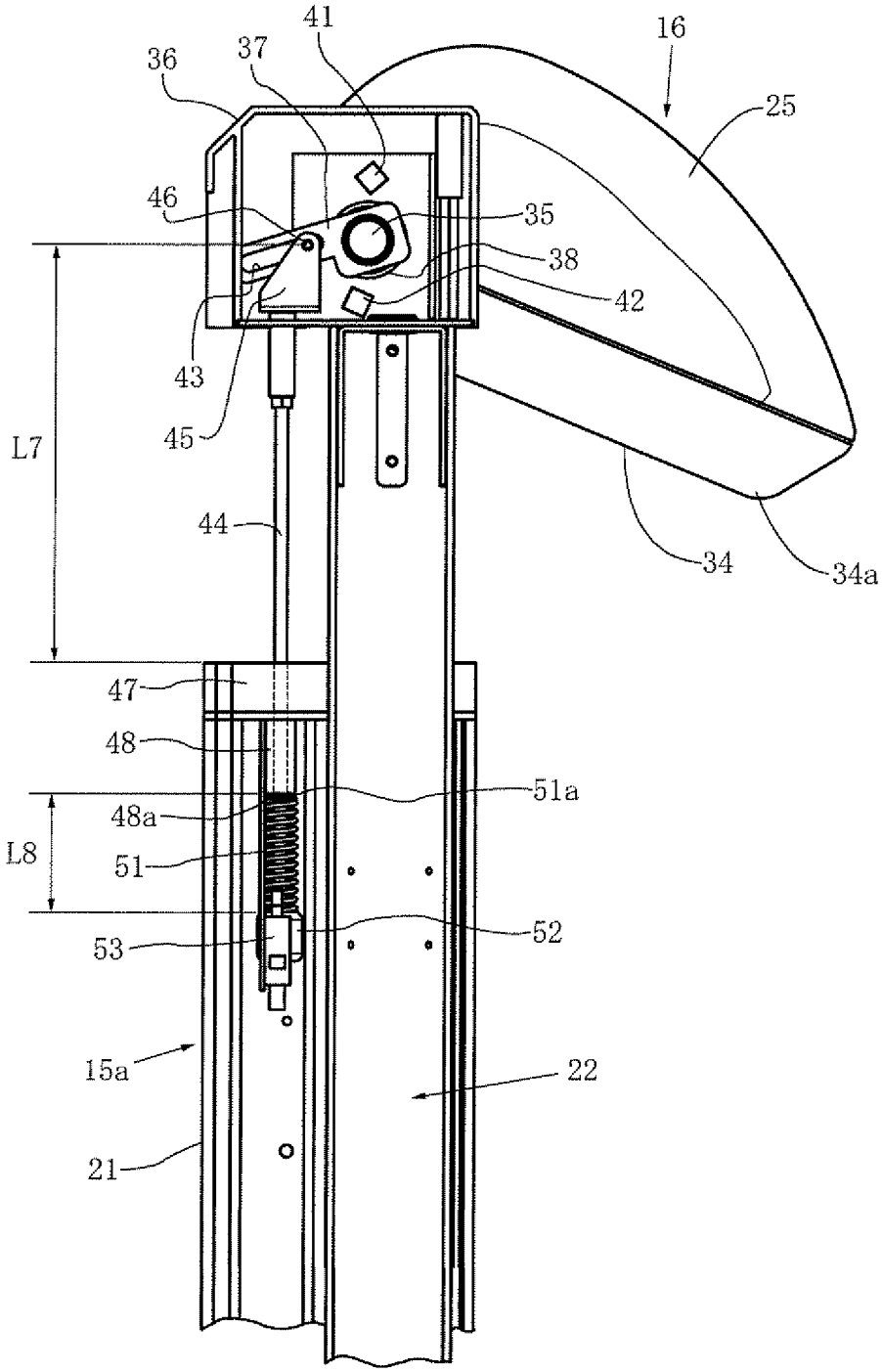
FIG. 12 is a partially enlarged sectional view schematically showing the main part in FIG. 9A.

When the movable strut 22 for the heater moves upward by a distance larger than the distance L5 (in other words, the distance L6) as shown in FIG. 12, the heater 16 and its support mechanism shift to the second transition stage shown in FIG. 12 because the control rod 44 cannot move upward beyond the amount of contraction (in other words, the length of contraction) of the coil spring 51. In this case, since the engaging pin 46 coupled to the control rod 44 moves forward in the long hole 43, the actuation lever 37 pivots counterclockwise in FIG. 11. For this reason, since the support shaft 35 pivots counterclockwise in the same manner as described above, accompanied by the actuation lever 37, the heater 16 also pivots counterclockwise in the same manner as described above, accompanied by the support shaft 35. Therefore, in the closed type state shown in FIG. 10 and the first transition stage shown in FIG. 11, the heater 16 which is supported by the support shaft 35 and naturally hangs downward pivots counterclockwise in FIG. 11 about the support shaft 35 as a fulcrum. Note that the tilt angle of the substantially rectangular heat radiation opening 34 of the heater 16 (in other words, the hood 25, and further in other words, the reflector 24) which is set when the heater 16 naturally hangs downward as described above is substantially 90° with respect to the horizontal direction in the embodiment shown in the accompanying drawings. In this case, as shown in F*ig*. 12, this tilt angle is the angle by which the heat radiation opening 34 tilts from its rear end side to the front end 34*a* side downward with respect to the horizontal direction (in other words, the heat radiation opening 34 faces the rear side opposite to the infant mat 4 side). In general, from a practical viewpoint, the above tilt angle is preferably falls within a range of 45° to 180° more preferably 60° to 120° and most preferably 70° to 110°.

In the second transition stage (see FIG. 12), let L7 be the distance from the upper end face of the upper end portion 47 of the stationary strut 21 for the heater to the center of the engaging pin 46 of the control rod 44 in the vertical direction, and let L8 be the length of the coil spring 51 (in this case, since the weight of the heater 16 is added to the coil spring 51 through the support shaft 35, the actuation lever 37 and the control rod 44, the length of the coil spring 51 can be slightly shorter than a natural length but is substantially the natural length). In this case, since the control rod 44 is substantially stationary, when the movable strut 22 further moves upward from the first transition stage shown in FIG. 11 through the second transition stage shown in FIG. 12, the actuation lever 37 further pivots forward counterclockwise shown in FIG. 12 about the support shaft 35 as a fulcrum in accordance with this amount of upward movement.

As the movable strut 22 for the heater keeps moving upward, the actuation lever 37 pivots forward until it comes into contact with the stopper 42 for forward pivoting, as shown in FIG. 13. In this case, in the open type state shown in FIG. 13, let L9 be the distance from the upper end face of the upper end portion 47 of the stationary strut 21 for the heater to the center of the engaging pin 46 of the control rod 44 in the vertical direction, and let L10 be the length of the coil spring 51. In this case, L9+L10≃L7+L8. If L8−L10=L11, the length L11 (not shown) is the amount by which the coil spring 51 contracts during the shift from the second transition stage shown in. FIG. 12 to the open type state shown in FIG. 13. Since the actuation lever 37 elastically comes into contact with the stopper 42 for forward pivoting with the spring force corresponding to the contraction amount L11 of the coil spring 51, the heater 16 is held at a predetermined position relative to the movable strut 22 so as to hold the tilt angle θ. In this case, when the state of the incubator shifts to the open type state or little before the shift to the open type state, the switch operator 52 of the control rod 44 operates the switch 53 to the ON state and so on. When the switch 53 is turned on in this manner, the rod-like heat generator 23 of the heater 16 is automatically energized. Alternatively, the heat generator 23 is ready for the above energization, and is energized when further operation is performed.

The forward moving operation in which the incubator 1 shifts from the closed type state to the open type state through the first and second transition stages has been described above. The backward moving operation in which the incubator 1 shifts from the open type state to the closed type state through the second and first transition stages is substantially inverse to the above forward moving operation, and hence a detailed description of the backward moving operation will be omitted. In the above backward moving operation, the heat radiation opening 34 of the reflector 24 of the heater 16 pivots backward from the state of the tilt angle e (i.e., about 26° shown in FIG. 13 (i.e., an upward angle relative to the horizontal direction) to the state of a tilt angle of about 90° shown in FIG. 10 (i.e., a downward angle relative to the horizontal direction). In other words, the heat radiation opening 34 pivots about the support shaft 35 as a fulcrum to change its direction downward by an angle of about 116°. The deflection angle of the heat radiation opening 34 in a case in which the heat radiation opening 34 changes its direction downward preferably falls within a range of 60° to 220°, more preferably 80° to 160° and most preferably 90° to 140° in general from a practical viewpoint.

5. Mutual Relationship between Heater and Top Hood

As shown in FIGS. 5 and 6, the top hood 17 is attached to and supported by the movable strut 22 of the top hood substrut 15*b*. For this purpose, a coupling member 54 as an additional part is attached to and supported by the top hood 17. The coupling member 54 is formed into a substantially crank shape from the parts respectively described in items (a) to (c):

(a) a first attaching portion 55 attached to the top hood 17, which is provided on the proximal end side of the coupling member 54 so as to extend in substantially the horizontal direction in FIG. 5, (b) a second attaching portion 57 attached to an upper end portion 56 of the movable strut 22 for the top hood, which is provided on the distal end side of the coupling member 54 so as to extend substantially in the vertical direction in FIG. 5, and (c) an intermediate coupling portion 58 which couples the left end portion of the first attaching portion 55 in FIG. 5 to the right end portion of the second attaching portion 57 in FIG. 5, and extends substantially in the horizontal direction in FIG. 6.

When the incubator shown in FIG. 5 is seen from the top, the first attaching portion 55 and intermediate coupling portion 58 of the coupling member 54, and the top hood 17 are vertically stacked on the heater 16 (including the support shaft 35 as an additional part of the heater 16). In other words, the heater components 16 and 35 including the heater 16 and the additional part 35 protrude from the elevation path of the top hood components 17 and 54 including the top hood 17 and the additional part 54. More specifically, referring to FIG. 1, the right end of the heater 16 is located more to the left than the left end of the intermediate coupling portion 58 of the coupling member 54 when seen from the top. There is a gap L12 between them. The gap L12 is about 1 to 2 cm. When the incubator 1 is in the closed type state shown in FIG. 1. (in other words, the heater 16 is in a non-operable state), the top hood components 17 and 54 can move up and down without making contact with the heater components 16 and 35. The same applies to the first transition stage shown in FIG. 3. As is obvious from FIG. 6, the elevation path of the second attaching portion 57 of the coupling member 54 is slightly apart from the elevation path of the heater components 16 and 35, and is located on a side of the elevation path of the heater components 16 and 35. There is therefore no possibility that the second attaching portion 57 will come into contact with the heater components 16 and 35.

In contrast to this, referring to FIG. 5, the right end of the heater 16 is located more to the right than the left end of the intermediate coupling portion 58 of the coupling member 54 when seen from the top. There is a gap L13 between them. The gap L13 is about 18 to 20 cm. When, therefore, the incubator 1 is in the open type state shown in FIG. 5, the top hood components 17 and 54 cannot move up and down because they come into contact with the heater components 16 and 35. The same substantially applies to the second transition stage shown in FIG. 4.

Under the circumstances, when the incubator 1 is to be shifted from the closed type state shown in FIG. 1 to the open type state shown in FIG. 5, or from the open type state shown in FIG. 5 to the closed type state shown in FIG. 1, computer control or the like is performed to adjust the timing between the elevating operation of the movable strut 22 for the heater and the elevating operation of the movable strut 22 for the top hood. More specifically, the top hood 17 is moved upward when the heater 16 is in the close type state shown in FIG. 1 or in the first transition stage shown in FIG. 3, or when the heater 16 is in the state between the closed type state shown in FIG. 1 and the first transition stage shown in FIG. 3.

6. Effects of Incubator

The incubator 1 shown in FIGS. 1 to 13 has the effects described in items (a) to (d) as follows.

(a) The single incubator 1 can be used in the closed type state and the open type state, and can further be used as a resuscitation treating apparatus. This makes it possible to diagnose, treat, or care the infant lying on the upper surface of the mat 4 always in an optimal state.

(b) There is no need to operate the heater 16 and top hood 17 of the incubator 1 in such a manner that the infant lying on the upper surface of the mat 4 and people surrounding the incubator 1 have feelings that rough operation is performed. This will keep the infant and the surrounding people free from adverse effects in terms of mental health.

(c) When the incubator 1 used in the open type state is to be used upon being switched to the closed type state, there is no possibility that heat will stay in the top hood 17 or the remaining heat of the heater 16 will be transferred to the infant lying on the upper surface of the mat 4. This point will be clearer when considering that the heater 16 is located somewhat below the top hood 17 in the open type state as shown in FIG. 5, that the heat radiation opening 34 of the heater 16 faces the opposite side to the mat 4 in the closed type state as shown in FIG. 1, and that the heater 16 has no lid covering the heat radiation opening 34 in the closed type state.

(d) The incubator 1 can be used as the close type while the heater 16 is located at the lower position. This prevents the heater 16 from hitting or hooking on something while the incubator 1 in the closed type state is moved inside a hospital or the like. There is no possibility that the swing of the heater 16 will be amplified and the overall incubator 1 will unstably swing during such movement. There is therefore no possibility that the unstable swing of the overall incubator 1 will be transferred as an uncomfortable swing to the infant lying on the upper surface of the mat 4.

Having described a specific preferred embodiment of this invention with reference to the accompanying drawings, it is to be understood that the invention is not limited to that precise embodiment, and that various changes and modifications may be effected therein by one skilled in the art without departing from scope or spirit of the invention as defined in the appended claims.

For example, in the above embodiment, as the heat generator 23 of the heater 16, a substantially rod-like heat generator is used. It is, however, possible to use a substantially round heat generator such as a bulb-shaped heat generator. In this case, in particular, the heat radiation opening 34 can be formed into a shape other than a substantially rectangular shape, e.g., a substantially circular shape or a substantially elliptic shape.

In addition, the above embodiment is configured to allow the heater 16 to pivot forward and backward about the support shaft 35 as a fulcrum in order to allow the heat radiation opening 34 of the heater 16 to change its direction from the first state (see FIG. 5) to the second state (see FIG. 1). However, in order to allow the heat radiation opening 34 to deflect in the above manner, it is possible to provide one or a plurality of cam mechanisms each constituted by a cam having a cam groove and a cam follower controlled by the cam in place of the support shaft 35, and control the reciprocal movement of the heater 16 by using the cam mechanism.

The invention claimed is:

1. An infant care apparatus comprising a bed on which an infant is to be laid, and a heater configured to radiate heat rays to the bed, wherein the heat rays are radiated from a heat radiation opening of said heater to the bed, wherein the heat radiation opening is configured to change a direction thereof from a first state in which the heat radiation opening substantially faces the bed to a second state in which the heat radiation opening does not substantially face the bed, wherein the heat radiation opening is configured to change the direction thereof from the second state to the first state, wherein said heater is configured to move up and down, wherein the heat radiation opening is held in the first state when said heater is at an upper position, wherein the heat radiation opening is held in the second state when said heater is at a lower position, further comprising a heater strut to which said heater is attached, wherein said heater strut includes a stationary strut and a movable strut which is configured to move up and down with respect to the stationary strut and to which said heater is attached, wherein the heat radiation opening is held in the first state when the movable strut is at an upper position, wherein the heat radiation opening is held in the second state when the movable strut is at a lower position, wherein the heat radiation opening changes the direction thereof from the second state to the first state, accompanied by forwardly moving of the movable strut, when the movable strut moves forward from the lower position to the upper position, and wherein the heat radiation opening changes the direction thereof from the first state to the second state, accompanied by backwardly moving of the movable strut, when the movable strut moves backward from the upper position to the lower position.

2. An apparatus according to claim 1, wherein said heater is configured to pivot forward and backward about a fulcrum to change the direction of the heat radiation opening from the first state to the second state and from the second state to the first state.

3. An apparatus according to claim 1, wherein, when the heat radiation opening is held in the first state, a tilt angle by which the heat radiation opening tilts upward from a rear end side thereof to a front end side thereof with respect to a horizontal direction falls within a range of 12° to 50°.

4. An apparatus according to claim 1, wherein, when the heat radiation opening is held in the first state, a tilt angle by which the heat radiation opening tilts upward from a rear end side thereof to a front end side thereof with respect to a horizontal direction falls within a range of 16° to 38°.

5. An apparatus according to claim 1, wherein, when the heat radiation opening is held in the first state, a tilt angle by which the heat radiation opening tilts upward from a rear end side thereof to a front end side thereof with respect to a horizontal direction falls within a range of 20° to 32°.

6. An apparatus according to claim 1, wherein, when the heat radiation opening is held in the second state, a tilt angle by which the heat radiation opening tilts downward from a rear end side thereof to a front end side thereof with respect to a horizontal direction falls within a range of 45° to 180°.

7. An apparatus according to claim 1, wherein, when the heat radiation opening is held in the second state, a tilt angle by which the heat radiation opening tilts downward from a rear end side thereof to a front end side thereof with respect to a horizontal direction falls within a range of 60° to 120°.

8. An apparatus according to claim 1, wherein, when the heat radiation opening is held in the second state, a tilt angle by which the heat radiation opening tilts downward from a rear end side thereof to a front end side thereof with respect to a horizontal direction falls within a range of 70° to 110°.

9. An apparatus according to claim 1, wherein an angle of deviation of the heat radiation opening set when the heat radiation opening changes a direction thereof from the first state to the second state falls within a range of 60° to 220°.

10. An apparatus according to claim 1, wherein an angle of deviation of the heat radiation opening set when the heat radiation opening changes a direction thereof from the first state to the second state falls within a range of 80° to 160°.

11. An apparatus according to claim 1, wherein an angle of deviation of the heat radiation opening set when the heat radiation opening changes a direction thereof from the second state falls within a range of 90° to 140°.

12. An apparatus according to claim 1, further comprising a top hood configured to move up and down, wherein the infant care apparatus is configured to serve as a closed type incubator when said top hood is held at a lower position, wherein the infant care apparatus is configured to serve as an open type incubator when said top hood is held at an upper position, wherein heater components including said heater do not protrude from an elevation path of top hood components including said top hood when the heat radiation opening is held in the second state, and the heater components protrude from the elevation path of the top hood components when the heat radiation opening is held in the first state.

13. An apparatus according to claim 12, wherein the heater components include said heater and an additional part of said heater which moves up and down accompanying said heater.

14. An apparatus according to claim 12, wherein the top hood components include said top hood and an additional part of said top hood which moves up and down accompanying said top hood.

15. An apparatus according to claim 12, wherein computer control performs to adjust the timing between the elevating operation of said heater and the elevating operation of said top hood.

* * * * *